United States Patent [19]

Murakami et al.

[11] Patent Number: 4,666,336

[45] Date of Patent: May 19, 1987

[54] METHOD OF AND APPARATUS FOR BUILDING THIN LINING ON TUNNEL

[75] Inventors: Susumu Murakami, Sakai; Satoshi Fujita, Osaka, both of Japan

[73] Assignee: Okumura Corporation, Osaka, Japan

[21] Appl. No.: 780,254

[22] Filed: Sep. 26, 1985

[51] Int. Cl.[4] ..... E21D 11/10

[52] U.S. Cl. ..... 405/138; 405/140; 405/150

[58] Field of Search ..... 405/140, 146, 150, 138, 405/260, 288

[56] References Cited

U.S. PATENT DOCUMENTS

| | | | |
|---|---|---|---|
| 3,407,609 | 10/1968 | Kosogorin | 405/140 |
| 3,413,811 | 12/1968 | Giacobino | 405/140 |
| 4,459,064 | 7/1984 | Berset | 405/150 X |

*Primary Examiner*—David H. Corbin

*Attorney, Agent, or Firm*—Birch, Stewart, Kolasch and Birch

[57] ABSTRACT

A method and an apparatus for building a thin lining on a tunnel to be excavated. The method includes the steps of boring a slot along an outer periphery of a cross section of the tunnel, filling lining material into the slot so as to form the lining material into the thin lining and removing bedrock surrounded by the thin lining so as to expose the thin lining. The apparatus includes a boring device for boring a slot in the tunnel and an injection device for injecting lining material into the slot. The boring device further includes a hollow frame, a plurality of rods fitted axially movably into the hollow frame, and a drive mechanism for rotating the rods and striking rear ends of the rods.

18 Claims, 8 Drawing Figures

METHOD OF AND APPARATUS FOR BUILDING THIN LINING ON TUNNEL

BACKGROUND OF THE INVENTION

The present invention generally relates to lining of a tunnel and more particularly, to a method of and an apparatus for building a thin lining on a peripheral wall of the tunnel.

Conventionally, in methods of building a thin lining on a tunnel, it has been generally so arranged as shown in FIG. 1 that concrete c is sprayed on a peripheral wall of a tunnel b by using a concrete spraying machine a, etc. However, in the prior art methods, since the lining operation is performed after the tunnel has been excavated, such a dangerous phenomenon takes place that it is impossible to prevent the natural ground of the tunnel from becoming loose during a time period from completion of excavation of the tunnel to start of the lining operation, thereby resulting in fall of rocks during the lining operation. Furthermore, the prior art methods are disadvantageous in that since it is difficult to finish the peripheral wall of the tunnel smoothly during excavation of the tunnel, the peripheral wall of the tunnel becomes uneven with the result that the tunnel is likely to be locally damaged due to stress concentration.

Moreover, in the known methods, since spraying concrete is employed for building the thin lining on the tunnel, a number of splashes of the concrete and a large amount of dust due to spraying of the concrete are produced, so that it is impossible to prevent a large amount of the loss of the lining material or deterioration of the working environments and it becomes difficult to perform the lining operation at a site having a spring water.

In addition, the known methods have such an inconvenience that since the thin lining is built along the uneven peripheral wall of the excavated tunnel, it is impossible to perform the lining operation in conformity with design dimensions of a cross-section of the tunnel.

SUMMARY OF THE INVENTION

Accordingly, an essential object of the present invention is to provide a method of and an apparatus for building a thin lining on a tunnel, in which the thin lining is built prior to excavation of the facing of the tunnel, with substantial elimination of the disadvantages inherent in conventional methods and apparatuses of this kind.

In order to accomplish this object of the present invention, a method of building a thin lining on a tunnel to be excavated, embodying the present invention comprises the steps of: boring a slot along an outer periphery of a cross section of said tunnel such that said slot extends over a predetermined depth obliquely outwardly in a direction of excavation of said tunnel; filling lining material into said slot so as to form said lining material into said thin lining; and removing bedrock surrounded by said thin lining so as to expose said thin lining.

BRIEF DESCRIPTION OF THE DRAWINGS

This object and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
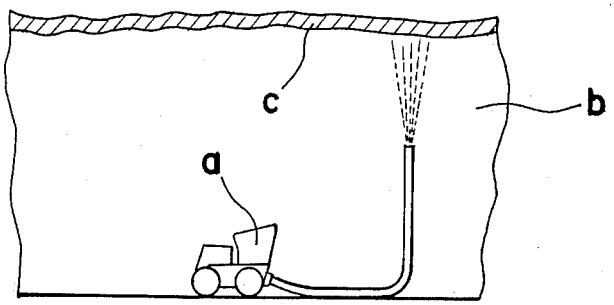
Fig. 1 PRIOR ART
FIG. 1 is a schematic view explanatory of a prior art lining method (already referred to)
Figure 2:
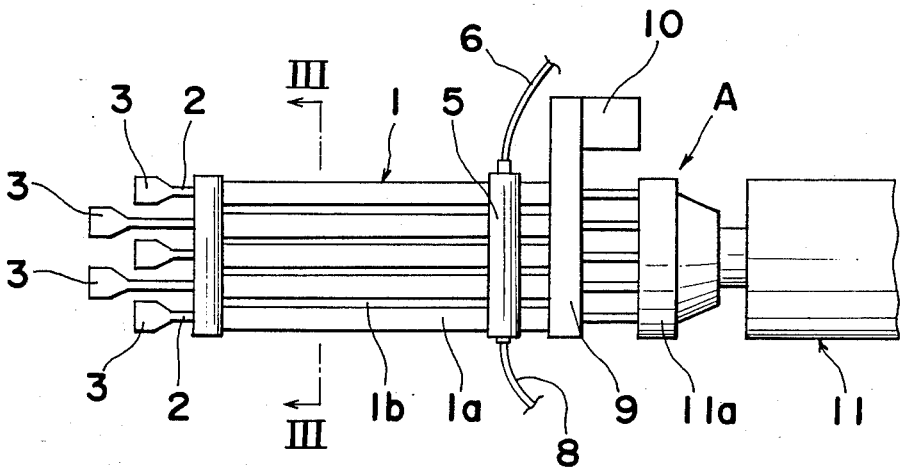
FIG. 2 is a top plan view of a lining apparatus according to the present invention.
Figure 3:
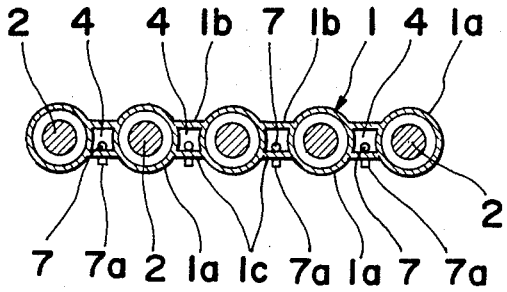
FIG. 3 is a cross-sectional view taken along the line III—III in FIG. 2.
Figure 4:
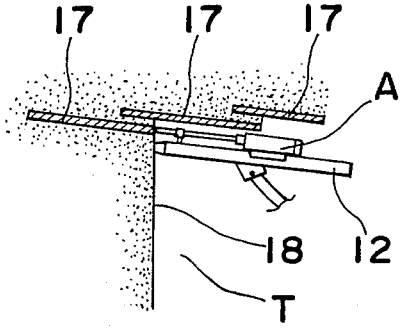
FIG. 4 is a schematic side elevational view explanatory of operation of the lining apparatus of FIG. 2.
Figure 5:
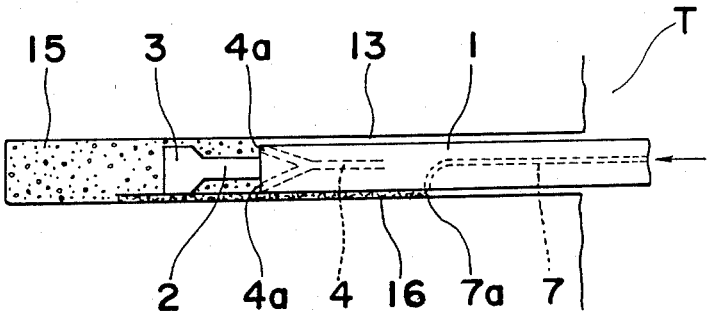
FIG. 5 is an enlarged longitudinal sectional view explanatory of lining operation of the lining apparatus of FIG. 2.

Referring now to the drawings, there is shown in FIGS. 2 to 5, a lining apparatus A for building a thin lining on a tunnel T, according to the present invention. The lining paaratus A includes a frame 1 having a plurality of support pipes 1*a* arranged in parallel with each other, a plurality of rods 2 extending through the support pipes 1*a*, respectively, and a chamber 5 mounted on a rear end portion of the frame 1. The rods 2 each having a bit 3 formed on its front end portion are axially movably supported by the support pipes 1*a*, respectively such that a slot 13 is bored on the tunnel T by the bit 3 projecting out of a front end of each of the support pipes 1*a* as will be described later. It is to be noted here that front and rear portions of the lining apparatus A correspond to leftward and rightward portions in FIGS. 2 or 4, respectively, hereinbelow. Adjacent ones of the support pipes 1*a* are coupled, at upper and lower portions thereof, with each other by an upper spacer 1*b* and a lower spacer 1*c*, respectively such that a passage 4 for feeding lining material 15 (FIG. 5) is defined between adjacent ones of the support pipes 1*a* and between the upper and lower spacers 1*b* and 1*c*. As shown in FIG. 5, the passage 4 has an outlet 4*a* formed at its front end and opening at a front end of the frame 1. The passage 4 is communicated, at a rear end thereof, with the chamber 5. Meanwhile, an injection hose 6 for injecting the lining material 15 into the chamber 5 is connected with the chamber 5.

As shown in FIGS. 3 and 5, the lining apparatus A further includes a plurality of injection tubes 7 for injecting separating material 16 into the slot 13. Each of the injection tubes 7 is provided in the passage 4 and has an outlet 7*a* formed on its front end. The front end of each of the injection tubes 7 is passed through an aperture formed on the lower spacer 1*c* such that the outlet 7*a* opening through the aperture downwardly from the lower spacer 1*c* is spaced a proper distance rearwardly from the outlet 4*a*. Rear ends of the injection tubes 7 are connected, through the chamber 5, with a feed hose 8 for supplying the separating material 16 to the tubes 7.

Furthermore, the lining apparatus A includes a gearbox 9 mounted on the rear end of the frame 1 and a motor 10 secured to the gearbox 9. A plurality of gears (not shown), which are, respectively, mounted on the rods 2 projecting rearwardly from the rear end of the frame 1, are accommodated in the gearbox 9 and are sequentially brought into engagement with each other so as to be rotated by the motor 10.

Moreover, the lining apparatus A includes a striking device 11 provided rearwardly of the frame 1. Although not specifically shown, the striking device 11 having an anvil 11*a* is mounted on a support frame (not shown) so as to be coupled with the frame 1 properly such that rear end faces of all the rods 2 are simultaneously struck by the anvil 11*a*.

Hereinbelow, a method of the present invention of building the thin lining on the tunnel T by using the lining apparatus A of the above described arrangement will be described. Initially, as shown in FIG. 4, a guide support base 12 is secured so as to be directed, at a proper angle with respect to the direction of excavation of the tunnel T, obliquely outwardly towards a peripheral portion of a facing 18 of the tunnel T. Then, the lining apparatus A is forwardly and rearwardly slidably mounted on the guide support base 12. Subsequently, the motor 10 and the striking device 11 are driven so as to rotate and strike the rods 2 such that the slot 13 having a predetermined depth in the direction of excavation of the tunnel T is bored on the tunnel T.

Figure 8:
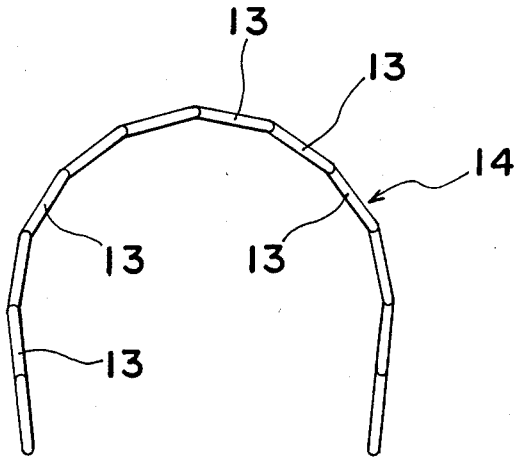
FIG. 8 is a front elevational view of an arcuate continuous slot formed by the lining apparatus of FIG. 2.

As shown in FIG. 8, the slot 13 is of a rectangular cross section having a small width and is directed slightly obliquely outwardly in the direction of excavation of the tunnel T. A plurality of the slots 13 of an identical shape and an identical depth are sequentially bored on the tunnel T by the lining apparatus A by displacing the guide support base 12 through a circumferential length of the rectangular cross section of the slot 13 sequentially in the circumferential direction of the tunnel T or reciprocating the guide support base 12 through several times the circumferential length of the rectangular cross section of the slot 13 in the circumferential direction of the tunnel T. Thus, an arcuate continuous slot 14 extending continuously along an outer periphery of a cross section of the tunnel T is formed by the slots 13.

In this case, each time one slot 13 is bored on the tunnel T, the lining material 15 is filled into the slot 13. Namely, as best shown in FIG. 5, one slot 13 having the predetermined depth is bored on the tunnel T by the rods 2. Thereafter, when the lining apparatus A is retracted along the guide support base 12, the lining material 15 such as mortar, resin, concrete, etc. is injected from a plurality of the outlets 4a into the slot 13 by way of the injection hose 6 and a plurality of the passages 4. At the same time, the separating material 16 such as oil acting as a release agent, foamed styrol, etc. is injected from a plurality of the outlets 7*a* onto the circumferentially inner face of the slot 13 via the feed hose 8 and a plurality of the injection tubes 7. At this time, since the outlets 7*a* for the separating material 16 are spaced the predetermined distance rearwardly from the outlets 4*a* for the lining material 15, only the lining material 15 is filled into the deepest portion of the slot 13. In the meantime, the separating material 16 is thinly attached, from and rearwardly of a position spaced the predetermined distance rearwardly from the deepest portion of the slot 13 in the direction of excavation of the tunnel T, to the circumferentially inner face of the slot 13. Subsequently, when the lining apparatus A is gradually retracted from the slot 13, the separating material 16 adheres to the circumferentially inner face of the slot 13 up to an opening of the slot 13, while the lining material 15 is filled in the slot 13 so as to overlap the separating material 16. After the lining apparatus A has been completely retracted from the slot 13, another slot 13 is formed and then, the lining material 15 and the separating material 16 are filled into the slot 13. By repeating these operational steps, an arcuate continuous lining 17, which is formed by the lining material 15 disposed at a circumferentially outer portion of the tunnel T to be excavated and the separating material 16 disposed at a circumferentially inner portion of the tunnel T, is built on the facing 18 of the tunnel T.

Figure 7:
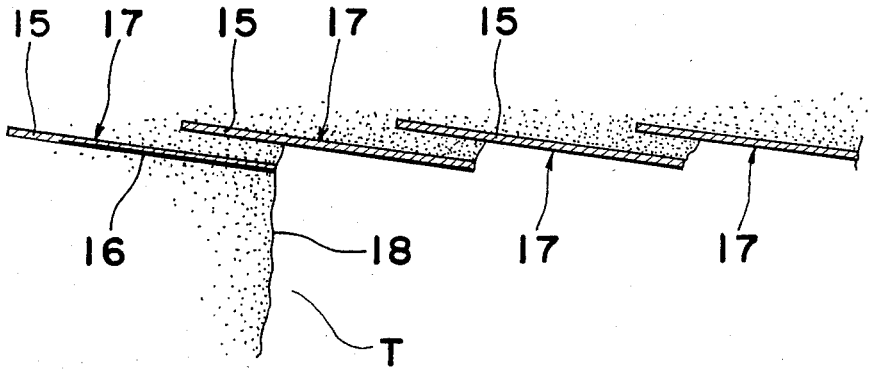
FIG. 7 is an enlarged longitudinal sectional view of a tunnel having thin linings built by the lining apparatus of FIG. 2.

Subsequently, after curing of the lining material 15, ground such as bedrock, etc. surrounded by the arcuate continuous lining 17 is excavated for removal by blasting or using a proper tunnel boring machine. Thereafter, another arcuate continuous lining 17 is built on the new facing 18 of the tunnel T in the same manner as described above. At this time, as shown in FIG. 7, a plurality of the continuous linings 17 are sequentially built such that the rear end portion of the subsequent continuous lining 17 is disposed circumferentially inwardly of the front end portion of the preceding continuous lining 17, so that the front end portion of the preceding continuous lining 17 overlaps the rear end portion of the subsequent continuous lining 17. Meanwhile, since the lining material 15 is protected and bedrock is smoothly released from the continuous lining 17 by the separating material 16 during excavation of the tunnel T, the lining material 15 can be exposed outwardly easily. Thus, sequential building of a plurality of such arcuate continuous linings 17 in the direction of excavation of the tunnel T and removal of ground from the tunnel T are alternately performed, whereby the tunnel T having the thin lining is built.

Figure 6:
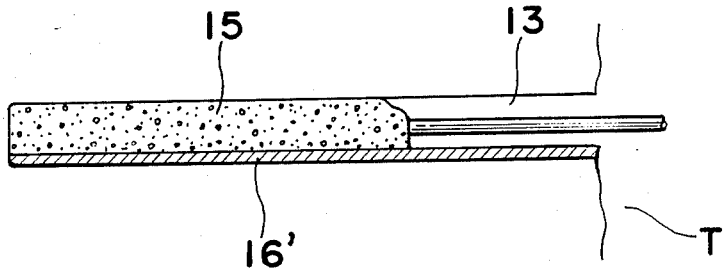
FIG. 6 is a view similar to FIG. 5, particularly showing a modification thereof.

Meanwhile, the lining apparatus A is provided with the injection means 4 and 6 for the lining material 15 and the injection means 7 and 8 for the separating material 16 in this embodiment. However, it can also be so arranged that after the arcuate continuous slot 14 has been bored by the rods of a slot drilling machine which is not provided with such injection means, the lining material 15 and the separating material 16 are filled into the continuous slot 14. Furthermore, it can also be so arranged that each time one slot 13 has been bored, the lining material 15 and the separating material 16 are filled into the slot 13. In this case, as shown in FIG. 6, a sheet member 16' can be employed as the separating material 16 and one of steel members such as a wire gauze, a steel sheet pile, a steel pipe, etc. or one of fibers such as steel fiber, glass fiber, polyethylene fiber, etc. can be employed as a reinforcing material for the lining material 15.

As is clear from the foregoing description, in the lining method of the present invention, the slot extending over the predetermined depth obliquely outwardly in the direction of excavation of the tunnel is bored along the outer periphery of the cross section of the tunnel and then, the lining material such as mortar, concrete, etc. is filled into the slot so as to cast the lining material into the thin lining. Thereafter, the bedrock surrounded by the thin lining is removed so as to expose the thin lining.

Accordingly, in accordance with the present invention, since the lining material is filled into the slot prior to excavation of the facing, such dangerous phenomena associated with prior art lining methods as fall of rocks, looseness of the natural ground after excavation of the facing, etc. do not take place.

Furthermore, in accordance with the present invention, since the tunnel can be excavated along the preformed lining face, the excavated surface of the tunnel can be finished smoothly, so that it becomes possible to prevent local damage of the tunnel due to stress concentration and reduce outbreak of the tunnel.

Moreover, in accordance with the present invention, since the bored slot is filled with the lining material by, for example, injecting the lining material thereinto, loss of the lining material is minimized.

In addition, in accordance with the present invention, since dust associated with prior art lining methods is not produced, working environments of the tunnel is improved.

Furthermore, in accordance with the present invention, the lining operation can be positively performed even at a site having a spring water.

On the other hand, in the lining apparatus of the present invention, since the slot is bored by a plurality of the rods arranged in parallel with each other in the frame such that the lining material is filled into the slot through the frame, the lining material can be filled into the slot upon boring of the slot, thereby resulting in improvement of efficiency of the lining operation.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A method of building a thin lining on a tunnel to be excavated, comprising the steps of:

boring a slot along an outer periphery of a cross section of said tunnel with boring means such that said slot extends over a predetermined depth in a direction of excavation of said tunnel;

introducing lining material into said slot during withdrawal of said boring means from said slot so as to form said lining material in said slot as a thin lining; and removing bedrock surrounded by said thin lining so as to expose said thin lining.

2. The method as claimed in claim 1, wherein at the time of or prior to filling of said lining material into said slot, a separating member is attached to a circumferentially inner face of said slot.

3. The method as claimed in claim 1, wherein said lining material is mortar, resin or concrete.

4. The method as claimed in claim 2, wherein said lining material is mortar, resin or concrete.

5. The method as claimed in claim 4, wherein said separating member is release agent or foamed styrol.

6. An apparatus for building a thin lining on a tunnel to be excavated, comprising:

removable boring means for boring a slot in said tunnel, said boring means comprising:

a hollow frame;

a plurality of rods each having a bit formed at a front end thereof, which are axially movably fitted into said hollow frame so as to be arranged in parallel with each other;

a drive mechanism for rotating said rods and striking the rear ends of said rods; and injection means for injecting lining material into said slot; said injection means comprising:

an injection hose which is connected with a rear end portion of said hollow frame such that said lining material is injected, through said hollow frame, from a front end portion of said hollow frame into said slot.

7. The apparatus as claimed in claim 6, wherein said drive mechanism includes a motor for rotating said rods and a striking device for striking said rear ends of said rods with an anvil.

8. The apparatus as claimed in claim 6, further comprising an injection member for injecting separating material onto a circumferentially inner face of said slot.

9. The apparatus as claimed in claim 7, further comprising an injection member for injecting separating material onto a circumferentially inner face of said slot.

10. A method of building a thin lining on a tunnel to be excavated, comprising the steps of:

boring a slot along an outer periphery of a cross section of said tunnel with boring means such that said slot extends over a predetermined depth obliquely outwardly in a direction of excavation of said tunnel;

withdrawing said boring means from said slot;

introducing lining material into said slot so as to form said lining material in said slot as a thin lining; and removing bedrock surrounded by said thin lining so as to expose said thin lining.

11. The method as claimed in claim 10, wherein at the time of or prior to filling of said lining material into said slot, a separating member is attached to a circumferentially inner face of said slot.

12. The method as claimed in claim 10, wherein said lining material is mortar, resin or concrete.

13. The method as claimed in claim 11, wherein said lining material is mortar, resin or concrete.

14. The method as claimed in claim 13, wherein said lining material is release agent or foamed styrol.

15. The method as claimed in claim 11, wherein said separating material is a sheet.

16. The method as claimed in claim 15, wherein said lining material is a steel member selected from the group consisting of wire gauze, steel sheet pile and steel pipe.

17. The method as claimed in claim 15, wherein said lining material is a fiber selected from the group consisting of steel fiber, glass fiber and polyethylene fiber.

18. The method as claimed in claim 1, wherein the boring step bores a slot which extends over a predetermined depth obliquely outwardly in a direction of excavation of said tunnel.

* * * * *